US007665343B2

(12) United States Patent
Ballas et al.

(10) Patent No.: US 7,665,343 B2
(45) Date of Patent: Feb. 23, 2010

(54) IDENTIFICATION ATTACHMENTS FOR COMPRESSION TOOLS

(75) Inventors: Richard W. Ballas, Westlake, OH (US); Craig Warner, North Olmsted, OH (US)

(73) Assignee: Emerson Electric Co, St. Louis, MO (US)

( * ) Notice: Subject to any disclaimer, the term of this patent is extended or adjusted under 35 U.S.C. 154(b) by 86 days.

(21) Appl. No.: 11/150,939

(22) Filed: Jun. 13, 2005

(65) Prior Publication Data

US 2006/0277967 A1 Dec. 14, 2006

(51) Int. Cl.
*B21D 37/10* (2006.01)
*B25B 7/00* (2006.01)

(52) U.S. Cl. ..... 72/416; 72/409.01

(58) Field of Classification Search ..... 72/416; 81/421, 488, DIG. 5, 427.5; 40/913, 628, 40/658, 647, 661.08
See application file for complete search history.

(56) References Cited

U.S. PATENT DOCUMENTS

| | | | | | |
|---|---|---|---|---|---|
| 1,156,396 | A | * | 10/1915 | Denio | 40/658 |
| 1,270,848 | A | * | 7/1918 | Long | 81/357 |
| 1,325,476 | A | * | 12/1919 | Kern | 40/652 |
| 1,532,901 | A | * | 4/1925 | Humphrey | 40/625 |
| 1,668,109 | A | * | 5/1928 | Egan | 40/651 |
| 2,016,644 | A | * | 10/1935 | Luball | 40/314 |
| 3,717,744 | A | * | 2/1973 | Pishioneri | 219/138 |
| 4,026,028 | A | * | 5/1977 | Green | 30/233 |
| 4,536,924 | A | | 8/1985 | Willoughby | |
| 5,279,140 | A | * | 1/1994 | Blake et al. | 72/31.01 |
| 5,341,707 | A | * | 8/1994 | Bond | 81/436 |
| 5,542,160 | A | | 8/1996 | Arndt | |
| 5,640,742 | A | | 6/1997 | White et al. | |
| 5,692,998 | A | | 12/1997 | Weigel | |

(Continued)

FOREIGN PATENT DOCUMENTS

DE 93 07 904 U1 8/1993

(Continued)

OTHER PUBLICATIONS

Electrical Master Catalog from Framatome Connectors USA, Inc. Burndy Electrical, "The Electrical Connector Selector", MC-95, pp. 1/1-1/3, Dated Aug. 23, 2004 (2007 Edition, p. N-20, 1/1, attached, with better graphics).*

(Continued)

*Primary Examiner*—Dana Ross
*Assistant Examiner*—Debra M Sullivan
(74) *Attorney, Agent, or Firm*—Rankin, Hill & Clark LLP

(57) ABSTRACT

An identification attachment is provided for a compression tool of the character having a pair of jawarms pivotally mounted between a pair of side plates by pivot pins having outer ends including pin retainers for maintaining the jawarms and side plates in assembled relationship. The jawarms have opposite sides, inner and outer edges and front and rear ends, respectively forwardly and rearwardly of the side plates, and the identification attachment is removably mountable on the tool independent of any mounting openings for the attachment extending through the jawarms. The attachment may, for example, interengage with opposite sides of a jawarm or be captured on the tool by the pin retainers or the side plates.

24 Claims, 10 Drawing Sheets

U.S. PATENT DOCUMENTS

| | | | | |
|---|---|---|---|---|
| 6,434,998 | B2 * | 8/2002 | Amherd | 72/416 |
| 6,739,217 | B2 * | 5/2004 | Hartranft et al. | 81/9.4 |
| 6,981,326 | B1 * | 1/2006 | Huang | 30/254 |
| 7,216,523 | B2 * | 5/2007 | Frenken | 72/416 |
| 2003/0061715 | A1 | 4/2003 | Heck et al. | |
| 2003/0106224 | A1 | 6/2003 | Huang | |
| 2004/0194323 | A1 * | 10/2004 | Lueck | 30/323 |
| 2005/0028651 | A1 * | 2/2005 | Crosser | 81/180.1 |
| 2005/0081687 | A1 * | 4/2005 | Konen | 81/427.5 |
| 2006/0000072 | A1 * | 1/2006 | Frenken | 29/237 |

FOREIGN PATENT DOCUMENTS

| | | | |
|---|---|---|---|
| DE | 295 05 853 | U1 | 12/1995 |
| DE | 297 18 204 | U1 | 1/1998 |
| EP | 1 172 718 | A1 | 1/2002 |
| FR | 2 187 644 | A1 | 6/2002 |
| GB | 800121 | | 8/1958 |

OTHER PUBLICATIONS

PCT International Search Report—(Form PCT/ISA/210); 7 pages.

PCT Notification of International Search Report and The Written Opinion of the International Searching Authority, or the Declaration—(Form PCT/ISA/220); 2 pages.

PCT Written Opinion of the International Searching Authority—(Form PCT/ISA/237); 9 pages.

PCT Invitation to Pay Additional Fees—PCT/US2006/022692; Date of Mailing Nov. 9, 2006 (Form PCT/ISA/206); 5 pages.

PCT International Search Report—PCT/US2006/022692; Date of Mailing Feb. 8, 2008 (Form PCT/ISA/210); 7 pages.

PCT Notification of International Search Report and the Written Opinion of the International Searching Authority, or the Declaration—PCT/US2006/02269; Date of Mailing Feb. 8, 2008 (Form PCT/ISA/220); 2 pages.

PCT Written Opinion of the International Searching Authority—PCT/US2006/022692; Date of Mailing Feb. 8, 2008 (Form PCT/ISA/237); 9 pages.

* cited by examiner

IDENTIFICATION ATTACHMENTS FOR COMPRESSION TOOLS

BACKGROUND OF THE INVENTION

This invention relates to the art of compression tools for joining pipes and couplings and, more particularly, to attachments for identifying the compression tool with respect to the pressing jaw size, tool name and/or the source of the tool.

A compression tool of the character to which the present invention relates is shown in U.S. Pat. No. 6,434,998 to Amherd. Such tools include a compression jawset removably mountable on a drive mechanism by which the jawarms of the set are displaced into compression about a pipe and coupling to join the latter. The jawset is comprised of a pair of jawarm members pivotally mounted between a pair of side plates and having laterally inwardly open opposed jaw recesses at one end and laterally inwardly facing cam surfaces at the opposite ends. The jawarms are pivotal about pins located in openings through the jawarms between the opposite ends thereof, and the jawarm members have laterally inner and outer edges between the opposite ends thereof. The jawarms are biased toward the closing direction of the opposed jaw recesses, and the jawset is mountable on the drive mechanism by means of the side plates and at a location relative to the jawset which is laterally between the pivot pins and cam surfaces of the jawarms. The drive mechanism includes cam rollers which are displaceable axially forwardly and rearwardly along the cam surfaces of the jawarms, and when displaced forwardly of the cam surfaces, the cams engage the latter and displace the opposed jaw recesses toward one another and constrictably about a pipe and coupling interposed therebetween.

The compression tool market has many manufacturers, and each manufacturer's press tool system includes a number of different sizes of pressing jaws. Most pressing jaws are designed to be or are capable of being used in competitors' tools, and all such tools are used in environments in which the tools are exposed to dirt and oil, and the environments of use are often poorly illuminated. Accordingly, the pressing jaws of different systems and manufacturers are difficult to distinguish, identify and handle. Most press jaw manufacturers identify their jaws using methods which, most often, result in the identifying indicia being difficult to read and/or lacking durability which leads to the inability to identify a jaw member. In this respect, for example, jaw members have been provided heretofore with identifying indicia by machine engraving, laser etching and decals, as well as through the use of forging dies and casting molds by which the pressing jaw members are manufactured. With the exception of decals, indicia provided in the foregoing manner is difficult to see, and decals are not durable and easily fall off when used in the field. As shown in German patent DE 297 18 204, one manufacturer has devised a U-shaped plastic strap having a bridging portion extending across the outer edge of a jawarm and legs extending downwardly along the opposite sides of the arm and which are interconnected by post and sleeve components on the legs which interengage in openings extending through the jawarm between the opposite sides thereof. The latter patent also discloses a plastic button-like disk which includes a post engaging in a bore extending into the jawarm. While the plastic material easily accepts printed indicia which is easily identified both at a distance and in poor light, the identifying devices are intentionally attached to the jawarm in a manner which results in their being destroyed upon removal from the jawarm. Accordingly, the attachments cannot be reused if, for example, one or both of the jawarms breaks and has to be replaced. Furthermore, the attachment of the U-shaped strap requires two openings through the jawarm and the attachment of the button-like disk requires a bore into the jawarm, and the provision of such holes and/or bores requires costly machining operations.

SUMMARY OF THE INVENTION

In accordance with the present invention, identifying attachments for a compression tool are provided which advantageously minimize and/or overcome the disadvantages and problems encountered in connection with prior identifying arrangements. More particularly in this respect, identifying attachments provided in accordance with the invention are removably mounted on a compression tool so as to be reusable and are mountable on the tool independent of the provision of any special mounting openings into or through component parts of the tool for the purpose of attaching the identifying device thereto. In accordance with one aspect of the invention, the attachment is U-shaped so as to straddle the outer edge of a jawarm of the tool and is made of a resilient material for the inner sides of the legs extending along the opposite sides of the jawarm to frictionally interengage therewith and/or to be contoured for interference with recesses in the jawarm. In accordance with another aspect of the invention, identifying attachments are retained on the tool by interengagement with at least one of the pivot pins. For example, the attachments are provided with openings for receiving one or both pivot pins of the compression tool and are retained against the outer side of a side plate of the tool by the pin retainers. In accordance with yet another aspect of the invention, an identifying attachment is provided with openings for receiving one or both pivot pins of the tool and is mounted on the tool between the outer side of a jawarm and the side plate of the tool overlying the outer side of the jawarm. In accordance with yet another aspect, the attachment is in the form of a sleeve surrounding the outer ends of the pivot pins.

The attachments can be made from a variety of different materials including, for example, polymers such as nylon, plastic sheet material and metal sheet materials, including aluminum, steel and spring metal. Attachments which are made of a plastic material can be color coded and are receptive of highly visible printing and/or embossing. Plastic and metal sheet material can be painted, printed upon, embossed or cut through to provide desired indicia including the tool size and, if desired, indicia identifying the product name and/or the source of the tool.

It is accordingly an outstanding object of the present invention to provide improvements in connection with providing a compression tool with identifying indicia.

Another object of the invention is the provision of a compression tool with an identifying attachment which can be removed from the tool for reuse.

Yet, another object is the provision of an identifying attachment for a compression tool which is removably mounted on the tool independent of any mounting openings provided in the tool for the attachment.

A further object is the provision of an attachment of the foregoing character which is removably retained thereon by at least one of frictional interengagement with opposite sides of a jawarm, interference with recesses in the opposite sides of a jawarm, and interengagement with at least one of the pivot pins of the tool.

Still another object is the provision of an attachment of the foregoing character which is removably retained on the tool by one of a pin retainer on the outer end of a pivot pin of the tool or a side plate of the tool.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings, in which.

DESCRIPTION OF PREFERRED EMBODIMENTS

Figure 1:
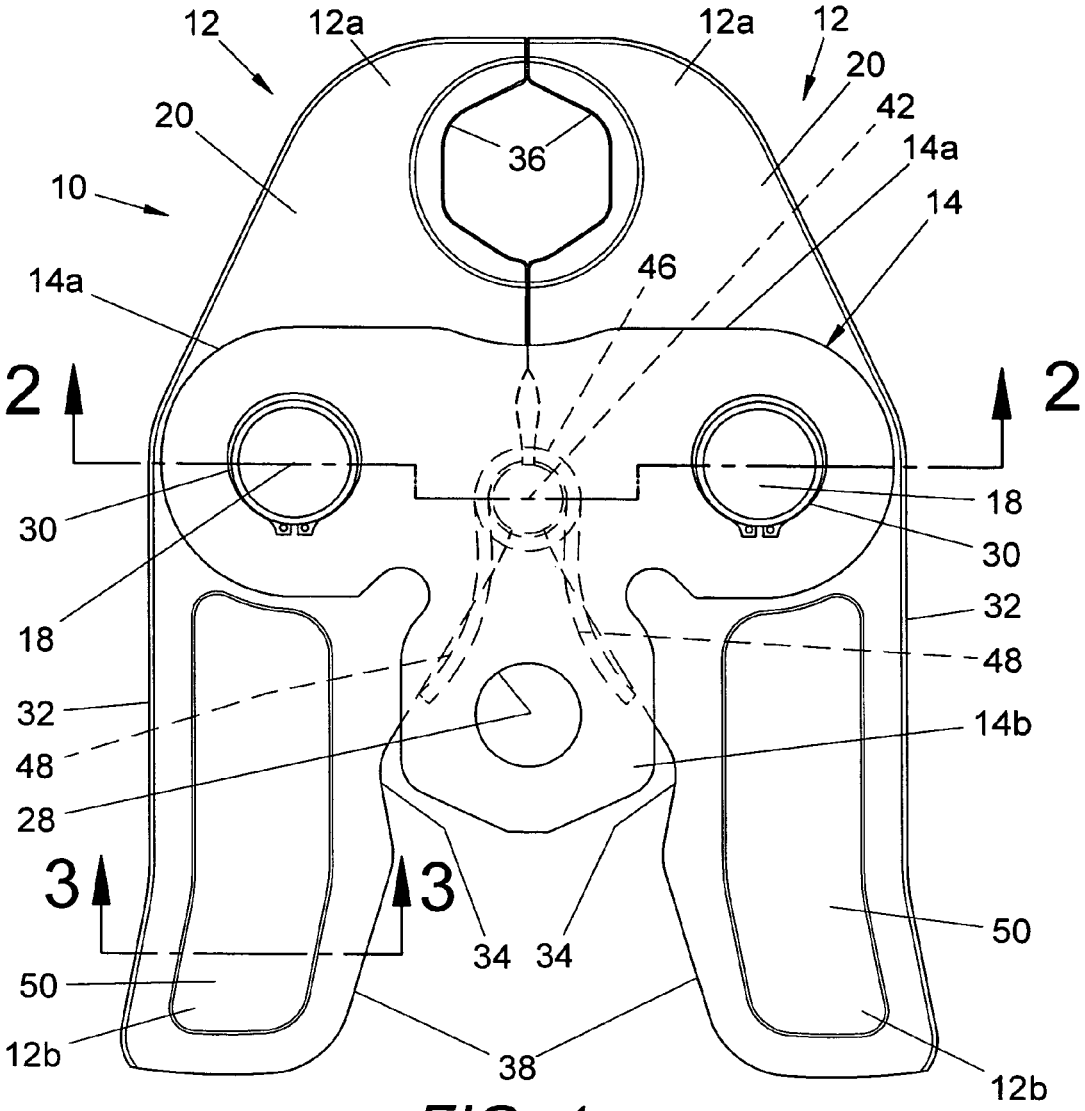
FIG. 1 is a plan view of a compression tool for receiving identification attachments in accordance with the invention.
Figure 2:
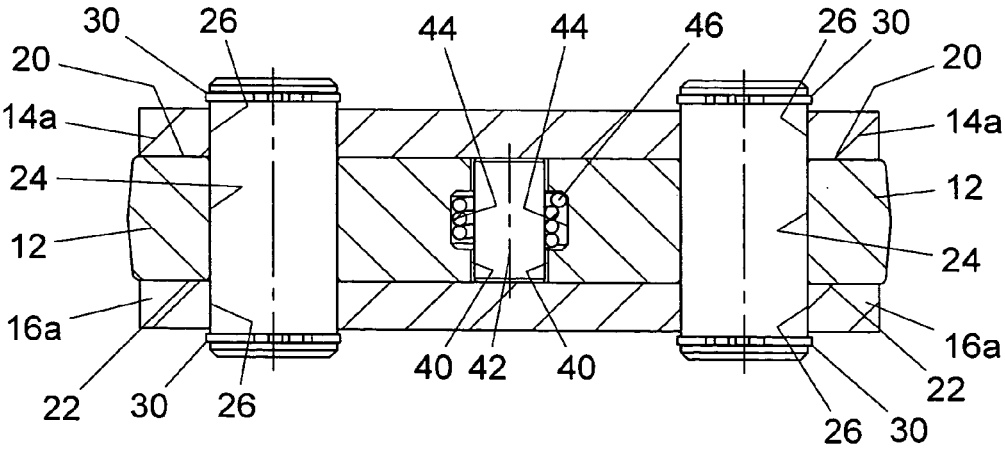
FIG. 2 is a cross-sectional elevation view of the compression tool taken along Line 2-2 in FIG. 1.
Figure 3:
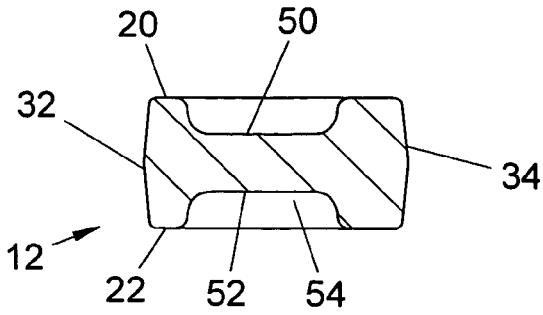
FIG. 3 is a cross-sectional elevation view of a jawarm of the tool taken along Line 3-3 in FIG. 1.

Referring now in greater detail to the drawings, wherein the showings are for the purpose of illustrating preferred embodiments of the invention only, and not for the purpose of limiting the invention, FIGS. 1-3 illustrate a jawset 10 comprising a pair of jawarm members 12 mounted, in the orientation shown in FIGS. 1-3, between top and bottom side plates 14 and 16, respectively, by a corresponding pivot pin 18. Each of the jawarm members 12 has a top side 20 and a bottom side 22 and a pivot pin opening 24 therethrough for receiving the corresponding pin 18. Side plates 14 and 16 are generally T-shaped and include laterally opposite side edges 14*a* and 16*a*, respectively, which are provided with aligned holes 26 for receiving the outer ends of the corresponding pin 18. Side plates 14 and 16 further include rear ends 14*b* and 16*b*, respectively, which are provided with aligned openings 28 therethrough which are adapted to receive a mounting pin by which the jawset is mounted on a drive unit in a well-known manner. The jawarm members and the side plates are retained in assembled relationship by pin retainers 30 in the form of spring clips at the opposite ends of each of the pins 18. Each of the jawarm members 12 has longitudinally opposite front and rear ends 12*a* and 12*b*, respectively, and each jawarm further includes laterally outer and inner edges 32 and 34, respectively, which are spaced from opening 24 and which extend forwardly and rearwardly of the opening. Inner edges 34 of the jawarm members provide a laterally inwardly open opposed jaw recesses 36 at front ends 12*a* and forwardly of side plates 14 and 16, and laterally inwardly facing cam surfaces 38 at rear ends 12*b* and rearwardly of the rear ends of the side plates. Inner sides 34 of the jawarm are provided with opposed inwardly open spring pin recesses 40 which together define a spring pin opening for a spring pin 42. Inner edges 34 of the jawarm members are further provided with corresponding pin spring recesses 44 which accommodate a torsion spring 46 which is coiled about pin 42 and which includes spring legs 48 which extend rearwardly along inner edges 34 of the jawarms. As shown in FIG. 3 with respect to rear end 12*b* of jawarm 12 on the left-hand side of FIG. 1, top and bottom sides 20 and 22 of each of the jawarms at the rear end thereof are provided with top and bottom recesses 50 and 52, respectively, which provide a web 54 between the opposite sides of the jawarm.

Figure 4:
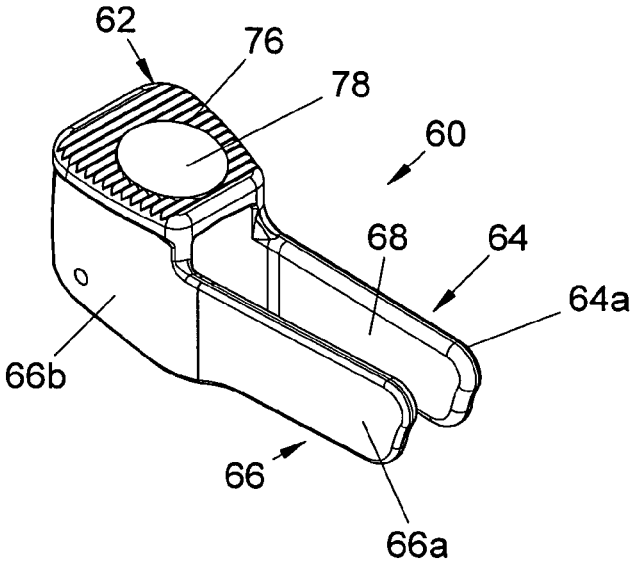
FIG. 4 is a perspective view of one embodiment of an identification attachment in accordance with the invention.
Figure 5:
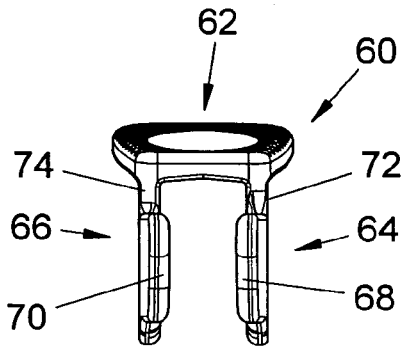
FIG. 5 is an end elevation view of the attachment looking in the direction from right to left in FIG. 4.
Figure 6:
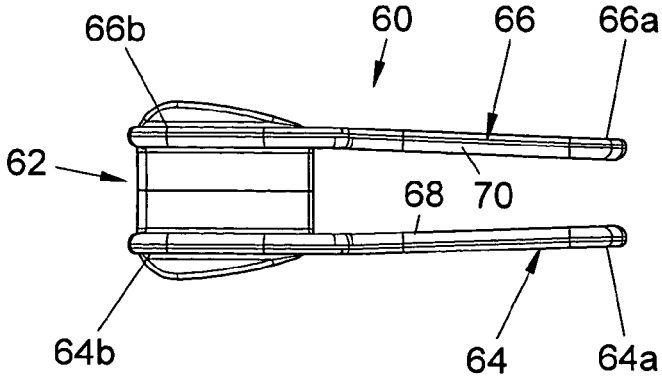
FIG. 6 is a bottom view of the attachment shown in FIG. 4.

A first embodiment of an identification attachment mountable on the jawarm of a compression tool in accordance with the invention is shown in FIGS. 4-6 of the drawing. More particularly in this respect, the attachment 60 is U-shaped in cross-section and includes a bridging portion 62 and a pair of legs 64 and 66 spaced apart from one another and extending downwardly from the bridging portion. Legs 64 and 66 have front ends 64*a* and 66*a*, respectively, and rear ends 64*b* and 66*b*, respectively, and bridging portions 62 interconnects the upper ends of the rear ends of the legs. Inner sides 68 and 70 of legs 64 and 66 are spaced below bridging portion 62 by a corresponding upper leg portion 72 and 74, respectively, and inner sides 68 and 70 of the legs are contoured to matingly interengage with recesses 50 and 52 of the jawarm to provide an interference between the legs and recesses for removably retaining the attachment on the jawarm. Further in this respect, the attachment is preferably made of a polymer such as nylon having a resiliency which allows the legs to spread outwardly from the orientation shown in FIG. 5 as the attachment is moved downwardly across the outer side edge of the jawarm and for the legs to be displaced back to the orientation shown in FIG. 5 when the inner sides enter the arm recesses. Preferably, as best seen in FIG. 6, legs 64 and 66 converge in the direction from the rear ends towards the front ends thereof to enhance retention of the attachment on a jawarm by providing a compressive force against the opposite sides of web 54 between recesses 50 and 52 of the jawarm. Preferably, the outer or upper side of bridging portion 62 is textured to facilitate gripping the jawarms of a compression tool to spread the jaw recesses thereof during use and, in this embodiment, such texturing is provided by ribs or serrations 76 extending transversely across the bridging portion. The outer sides of legs 64 and 66 of the attachment are adapted to receive indicia such as, for example, the manufacturer's name, the name of the product, the size of the tool or the like and, preferably, a portion 78 of the outer side of the bridging portion is left plain to receive indicia such as the tool size.

Figure 7:
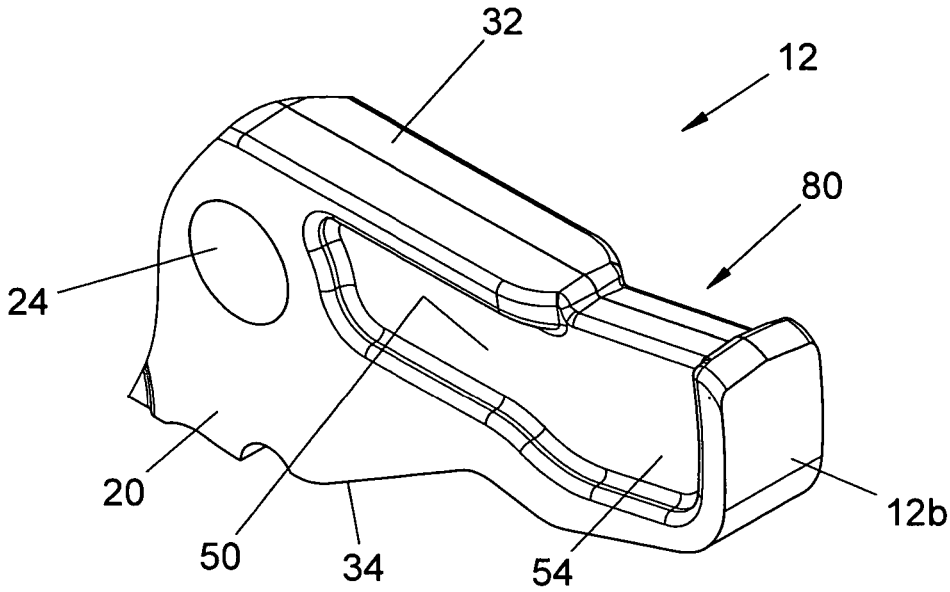
FIG. 7 is a perspective view of a jawarm modified to receive the attachment shown in FIG. 4.
Figure 8:
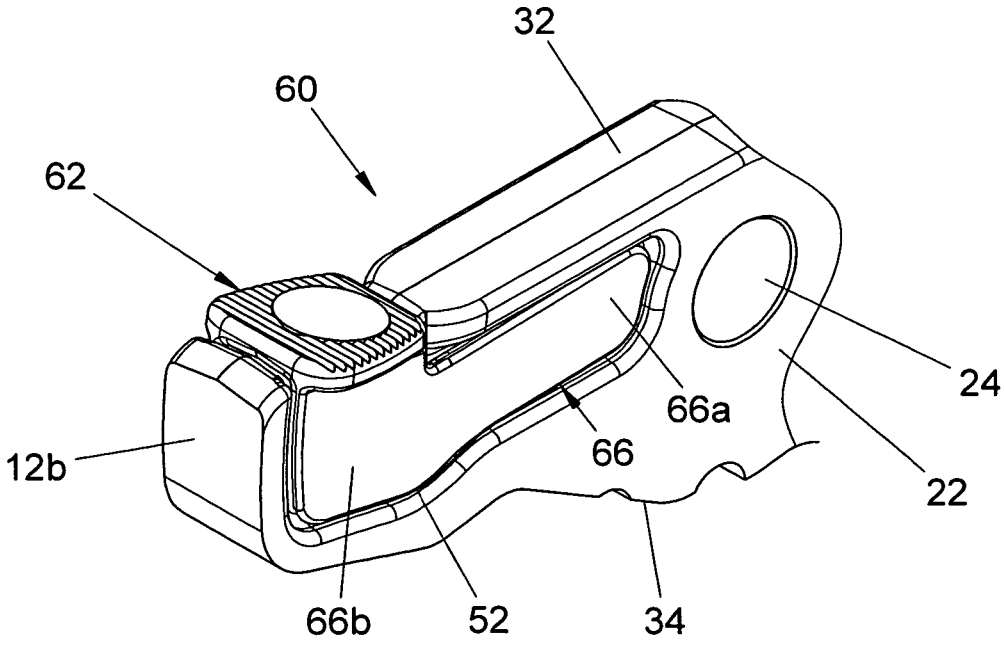
FIG. 8 is a perspective view of the jawarm of FIG. 7 with the attachment of FIG. 4 thereon.

As will become apparent hereinafter, it is not necessary to modify a jawarm for the latter to receive and retain an identification attachment such as attachment 60. Preferably, however, to promote a lower profile for the attachment, outer edge 32 and adjacent portions of the sides 20 and 22 of the jawarm are provided with a channel 80, as shown in FIG. 7, which extends across web 54 and opens into recesses 50 and 52 of the arm to accommodate the underside of bridging portion 62 and the upper portions 72 and 74 of legs 64 and 66 of the attachment. As will be appreciated from FIG. 8 and the foregoing description, legs 64 and 66 of the attachment are spread apart to receive outer edge 32 and the adjacent portions of sides 20 and 22 of the jawarm therebetween, and the attachment is pushed downwardly until the inner sides 68 and 70 of the legs enter the jaw recesses 50 and 52 and the underside of bridging portion engages in the upper end of channel 80. At this time, the resiliency of the polymer material from which the attachment is made returns legs 64 and 66 to the orientation shown in FIG. 5, whereby the inner sides 68 and 70 thereof are received in the jaw recesses for the attachment to be retained thereon by interference between the attachment and jawarm recesses.

Figure 9:
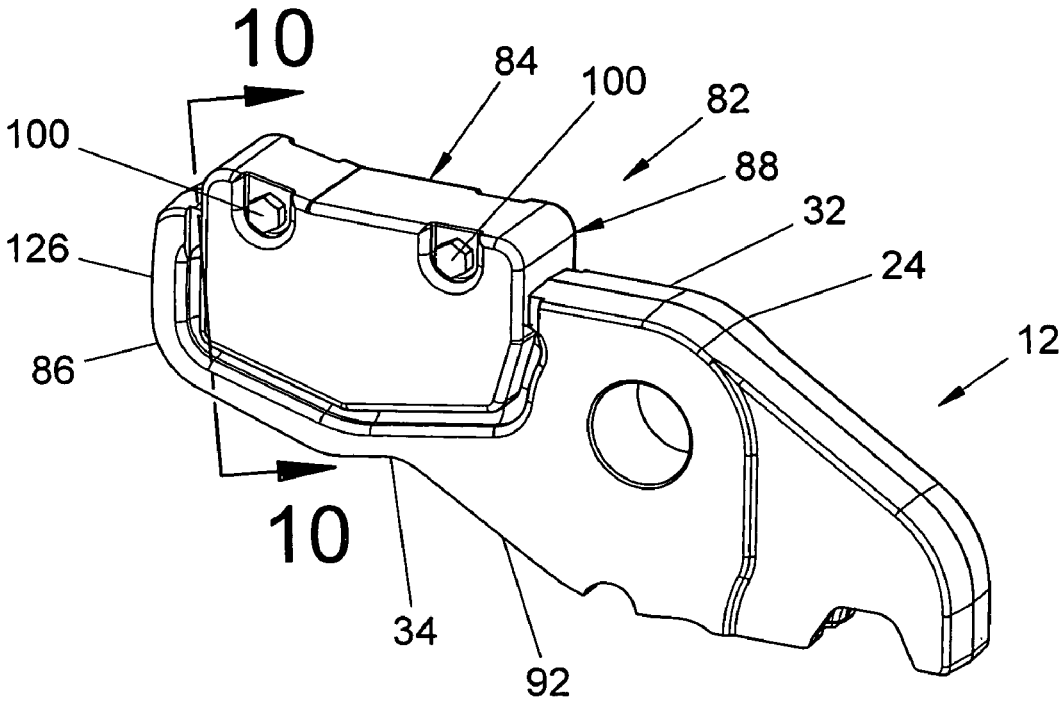
FIG. 9 is a perspective view of another embodiment of an identification attachment mounted on a jawarm of the tool shown in FIG. 1.
Figure 10:
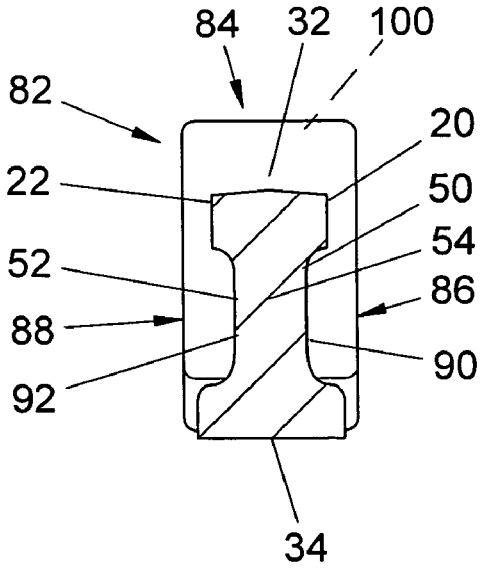
FIG. 10 is a rear elevation view of the attachment taken along Line 10-10 in FIG. 9.
Figure 11:
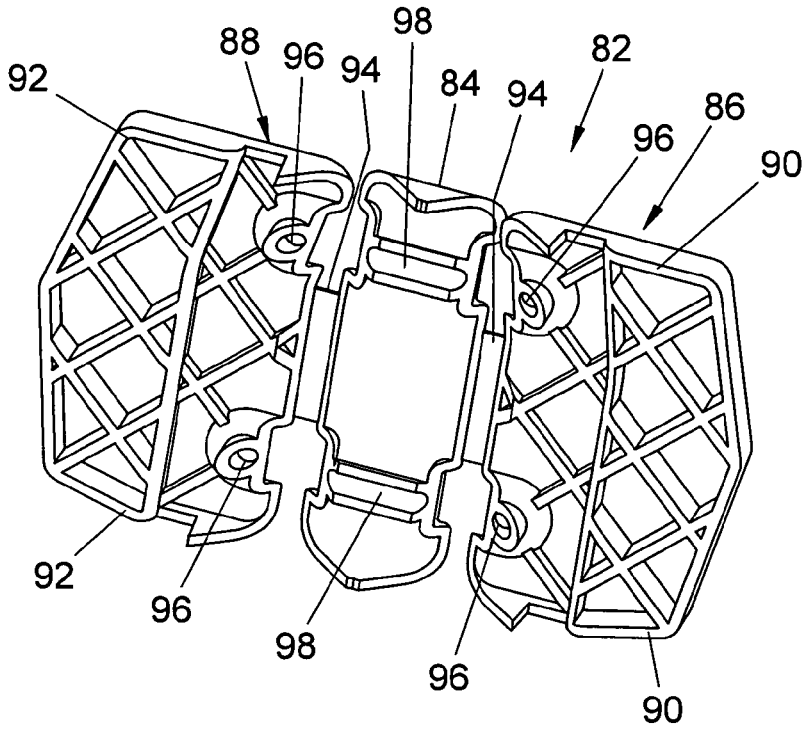
FIG. 11 is a perspective view of the attachment shown in FIG. 9 prior to mounting thereof on the jawarm.

FIGS. 9-11 illustrate another embodiment of an identification attachment in accordance with the invention. In this embodiment, the attachment 82 is U-shaped in cross-section when mounted on a jawarm 12 and comprises a bridging portion 84 extending across outer edge 32 of the jawarm and legs 86 and 88 extending downwardly along sides 20 and 22 of the jawarm and having inner sides 90 and 92, respectively, profiled to be received in jawarm recesses 50 and 52 for the attachment to be retained on the jawarm by interference of inner sides 90 and 92 with the jawarm recesses. In this embodiment, as will be appreciated from FIG. 11, the attachment is molded or otherwise formed in a flat configuration from a suitable plastic material to have hinged portions 94 between bridging portion 84 and each of the legs 86 and 88 which enable folding of the bridging portion and legs to the U-shaped configuration. Further, each of the legs 86 and 88 is provided with a pair of fastener openings 96 therethrough and bridging portion 84 is provided with a pair of channels 98 thereacross each of which is in alignment with a pair of the openings 96 of the two legs for receiving a fastener 100 by which the bridging portion and legs are retained in the U-shaped configuration. It will be appreciated that fasteners 100 can include a threaded shank having a head at one end and receiving a nut at the other end or, alternatively, can be in the form of a rivet or the like. As a further alternative, the bridging portion and legs can be provided with integral fastening components which snap together to hold the parts in place on the jawarm. With a fixed fastening arrangement such as a rivet, the plastic material preferably would be sufficiently resilient to enable the legs to be spread apart to facilitate mounting of the attachment across the outer edge of a jawarm whereas, with a removable or snap fit fastening arrangement, the plastic material of the attachment could be more rigid and would be mounted on the jawarm in connection with manipulating the fasteners to retain the bridging portion and legs in the U-shaped configuration. While it is preferred to have a one-piece construction as shown in FIG. 11, it will be appreciated that the bridging portion and legs can be produced as separate pieces. Again, the outer side surfaces of the legs and the outer surface of the bridging portion provide areas for suitable indicia such as, for example, the manufacturer's name and the size of the tool.

Figure 12:
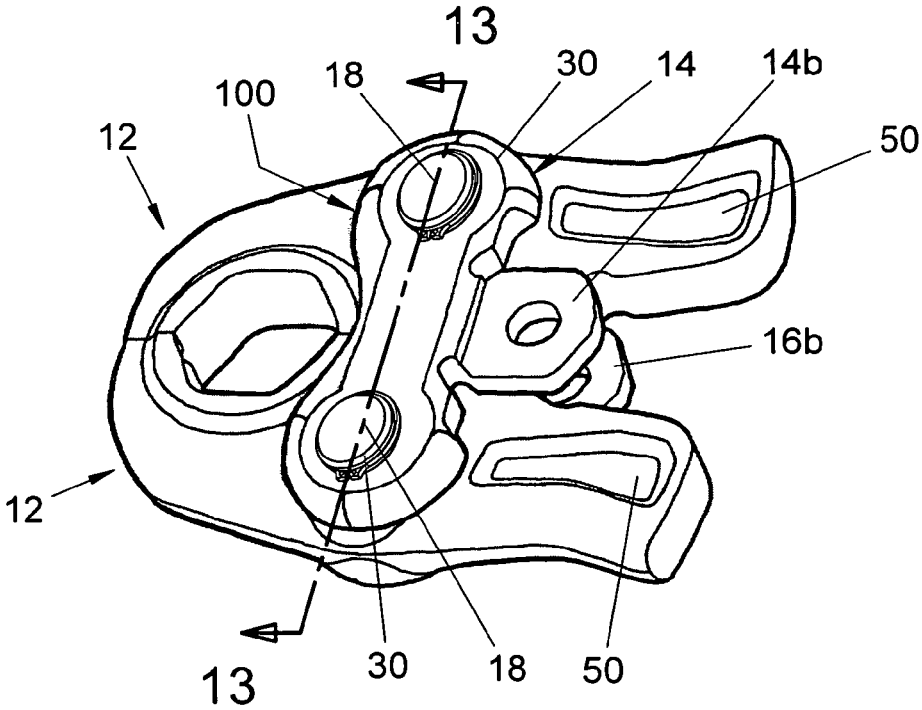
FIG. 12 is a perspective view of yet another embodiment of an identification attachment in accordance with the invention.
Figure 13:
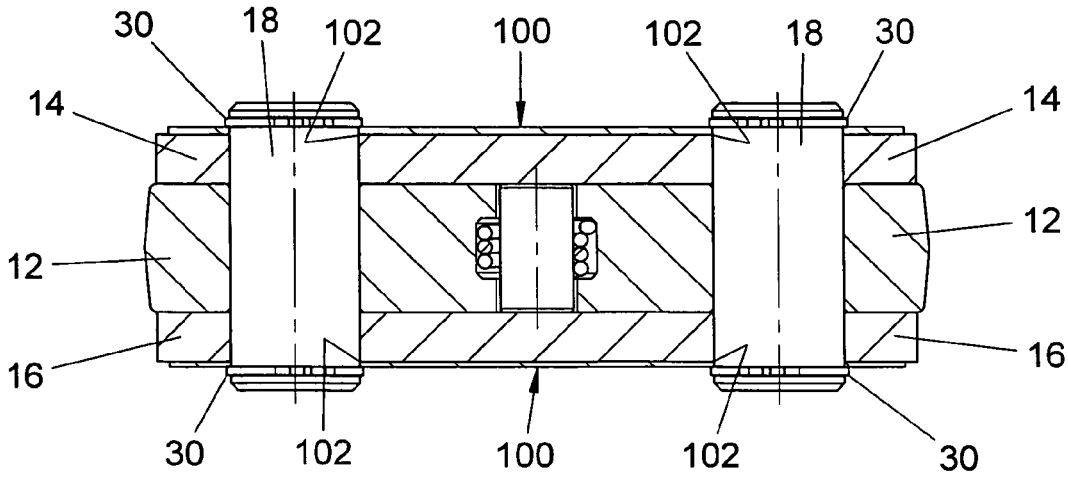
FIG. 13 is a sectional-elevation view taken along Line 13-13 in FIG. 12.

In the embodiment shown in FIGS. 12 and 13 of the drawing, an identification attachment 100 is in the form of a plate or sheet of metal or plastic material captured against the outer side of at least one of the side plates of a compression tool by the pin retainers 30 at the outer ends of pivot pins 18. More particularly in this respect, the opposite ends of the plate or sheet providing attachment 100 are provided with openings 102 for receiving the corresponding one of the pivot pins 18, and openings 102 are dimensioned such that pin retaining rings 30 engage against the outer side of the plate. The portion of the plate or sheet between pivot pins 18 provides areas for indicia.

Figure 14:
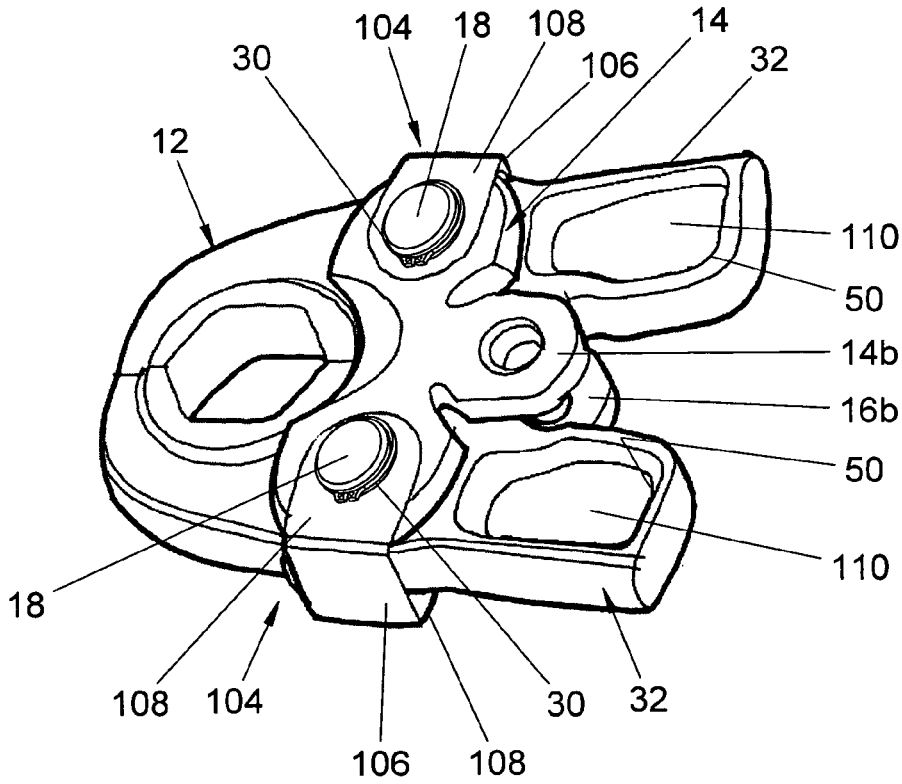
FIG. 14 is a perspective view of a compression tool provided with further embodiments of identification attachments in accordance with the invention.

FIG. 14 illustrates a modification of the embodiment illustrated in FIGS. 12 and 13 and, in this respect, a pair of U-shaped identification attachments 104 have bridging portions 106 extending across outer edges 32 of the jawarms and corresponding pairs of legs 108 extending inwardly in overlying relationship with side plates 14 and 16 of the compression tool. As will be appreciated from FIG. 13, legs 108 are provided with aligned openings for receiving the opposite ends of the corresponding one of the pivot pins 18, and the attachment is retained in place on the tool by pin retaining rings 30. The outer surface of bridging portions 106 provide areas for receiving indicia such as the tool size. FIG. 14 also illustrates another embodiment of an identification attachment in accordance with the invention and in which the attachment 110 is in the form of a plate of metal or plastic material having a profile corresponding to that of the jawarm recesses and which is oversized with respect to the recesses so as to provide a press fit relationship therewith.

In the embodiments illustrated in FIGS. 15-18 of the drawing, the identifying attachments are captured between a side plate and the corresponding side of a jawarm of a compression tool. In this respect, with regard first to FIGS. 15 and 16, identification attachment 112 is in the form of a plate or sheet of plastic or metal having opposite ends provided with openings 114 for receiving the corresponding one of the pivot pins 18 of the compression tool, and the plate is captured between the side plate and corresponding side of jawarms 12 by the pin retainers 30 which retain the jawarms and side plates in assembled relationship. As will be appreciated from the embodiment in FIG. 14, and as indicated by broken lines 116 in FIG. 16, the attachment 112 could be in the form of a one-piece sleeve or, alternatively, could be in the form of separate, U-shaped attachments captured between the side plates and jawarms.

Figure 16:
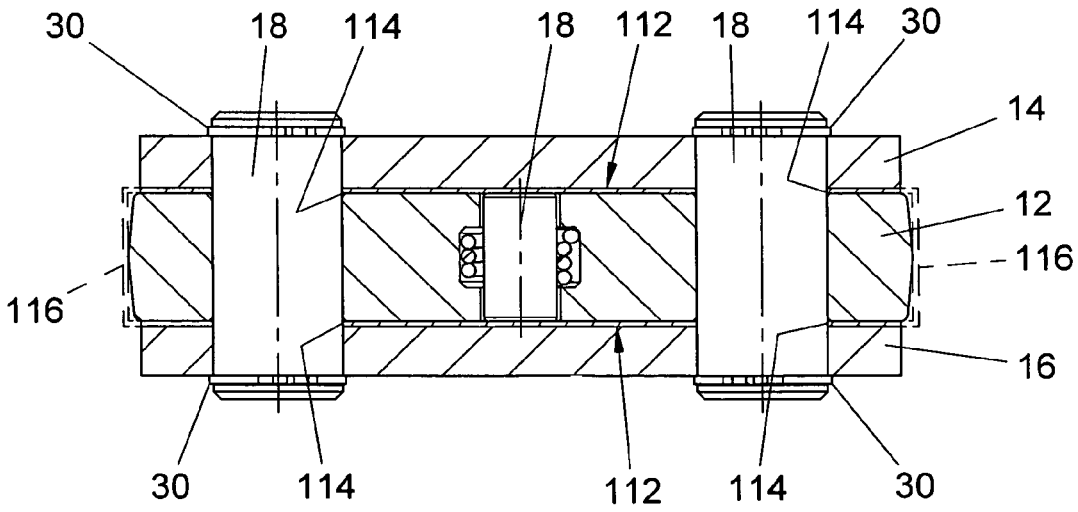
FIG. 16 is a sectional-elevation view taken along Line 16-16 in FIG. 15.
Figure 17:
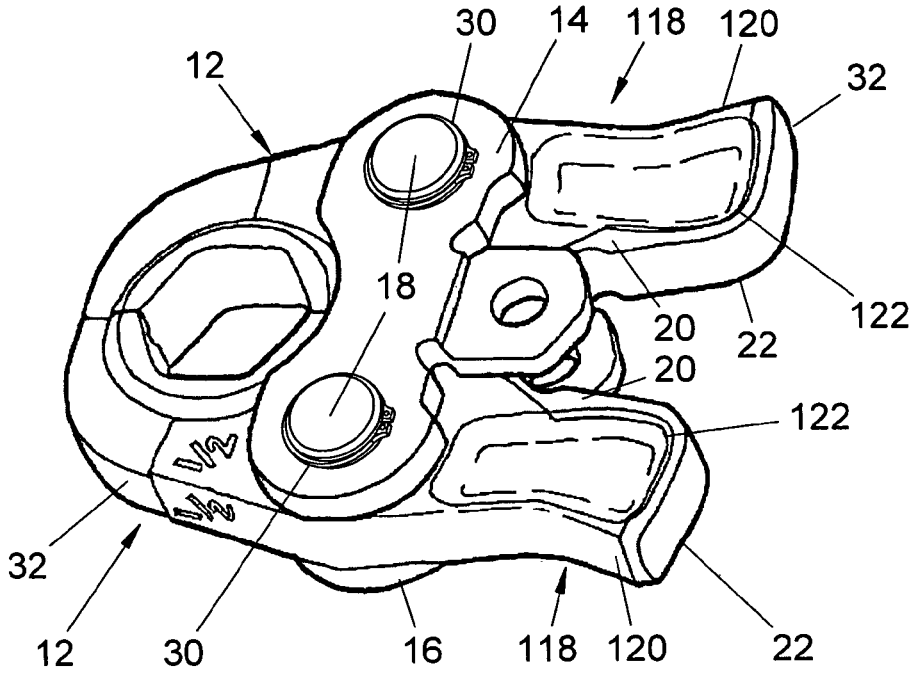
FIG. 17 is a perspective view of a compression tool showing a modification of the identification attachment of FIG. 15 mounted thereon.

The embodiment illustrated in FIG. 17 is of the latter character and, in this respect, includes a pair of U-shaped attachments 118 having bridging portions 120 extending across the outer edges 32 of the jawarms and legs 122 extending from the bridging portion across the opposite sides 20 and 22 of the jawarms. The attachments 118 are of sheet metal or plastic and the bridging portion and sides thereof extend forwardly and rearwardly of pivot pins 18 to overlie the sides of the jawarms and the recesses in the rear ends thereof. As will be appreciated from the embodiment of FIGS. 15 and 16, each of the attachments 118 is provided with aligned openings for receiving pivot pins 18, and the attachments are captured between side plates 14 and 16 and the outer sides of jawarms 12.

Figure 15:
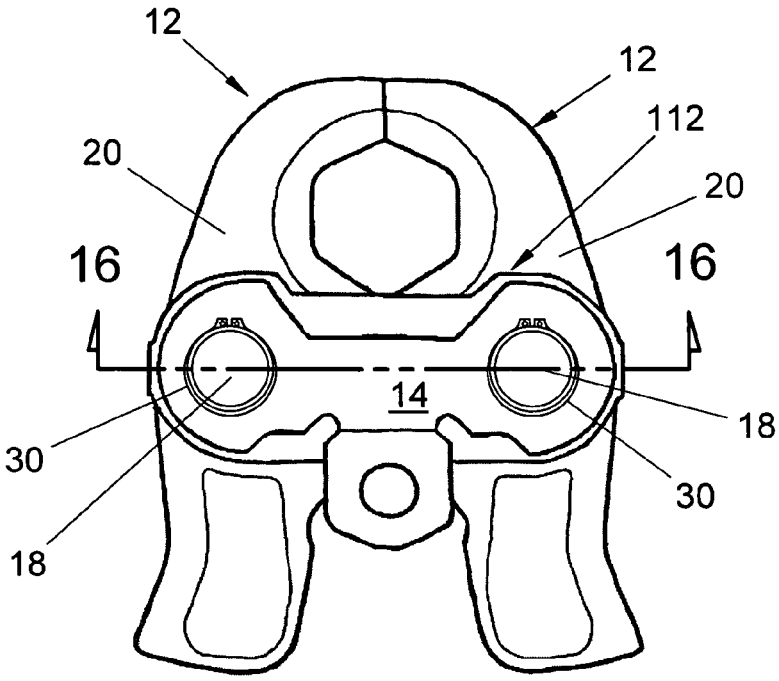
FIG. 15 is a plan view of a compression tool having yet another embodiment of an identification attachment thereon in accordance with the invention.
Figure 18:
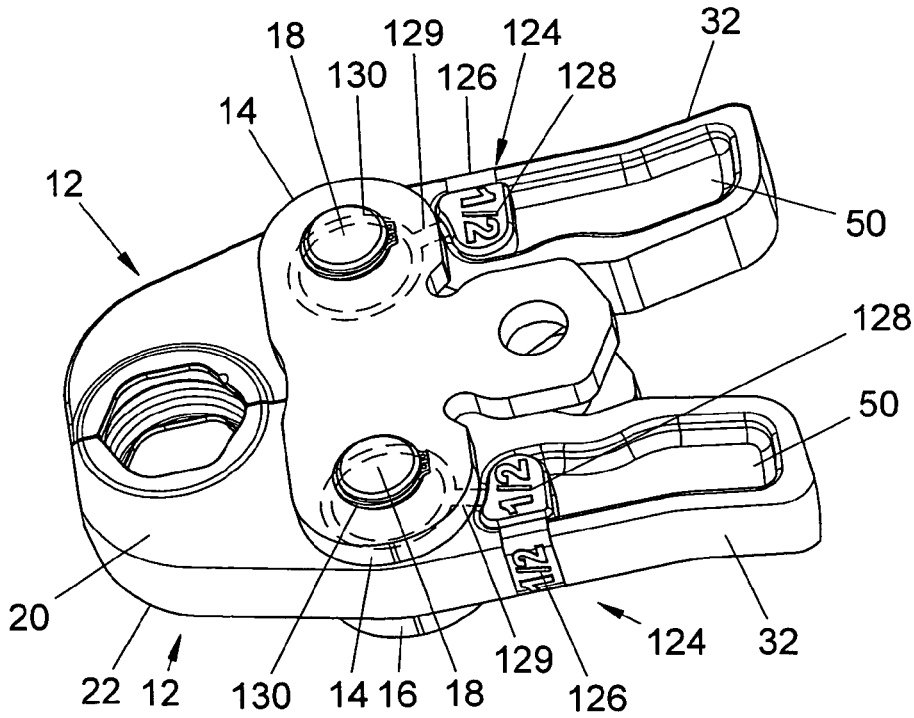
FIG. 18 is a perspective view of a compression tool having yet another modification of the identifying attachment of FIG. 15 mounted thereon.

FIG. 18 illustrates another modification of the embodiments illustrated in FIGS. 15-17 and, in this respect, shows U-shaped identification attachments 124 comprising a bridging portion 126 extending across the outer side 32 of a jawarm and legs 128 extending inwardly from the bridging portion along the opposite sides 20 and 22 of the jawarm and having inner sides received in the forward ends of the jaw recesses on opposite sides of the jawarm. Each of the legs 128 is provided with an integral mounting strap 129 extending therefrom between the outer side of the jawarm and the corresponding side plate of the compression tool and having a circular outer end 130 surrounding the corresponding pivot pin 18 of the tool, whereby the attachment is captured in the manner described hereinabove with regard to the embodiment of FIGS. 15 and 16. In this embodiment, the outer side of bridging portion 126 as well as the outer sides of legs 128 provide areas for receiving desired indicia.

Figure 19:
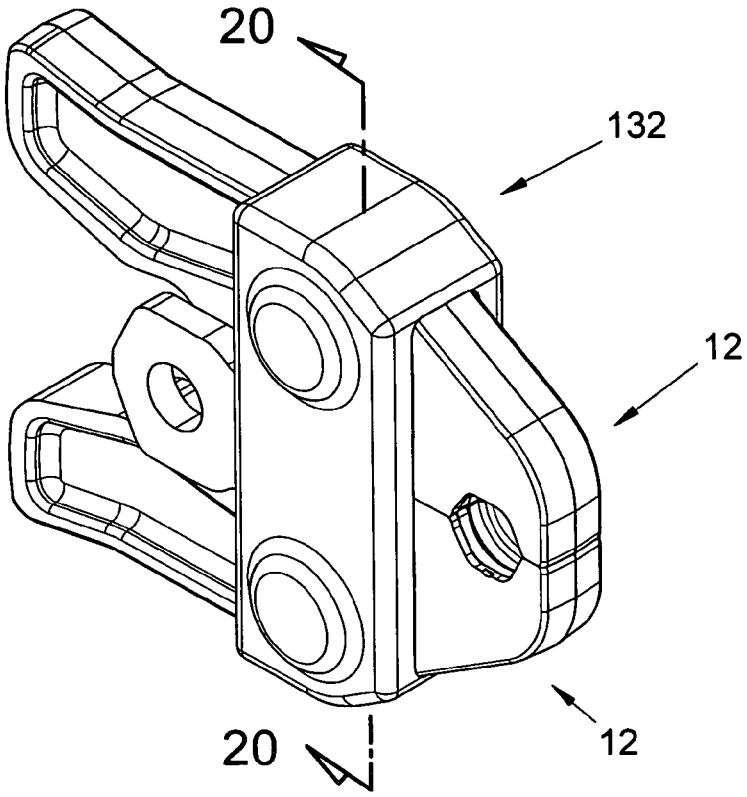
FIG. 19 is a perspective view of a compression tool having still a further embodiment of an identification attachment in accordance with the invention mounted thereon.
Figure 20:
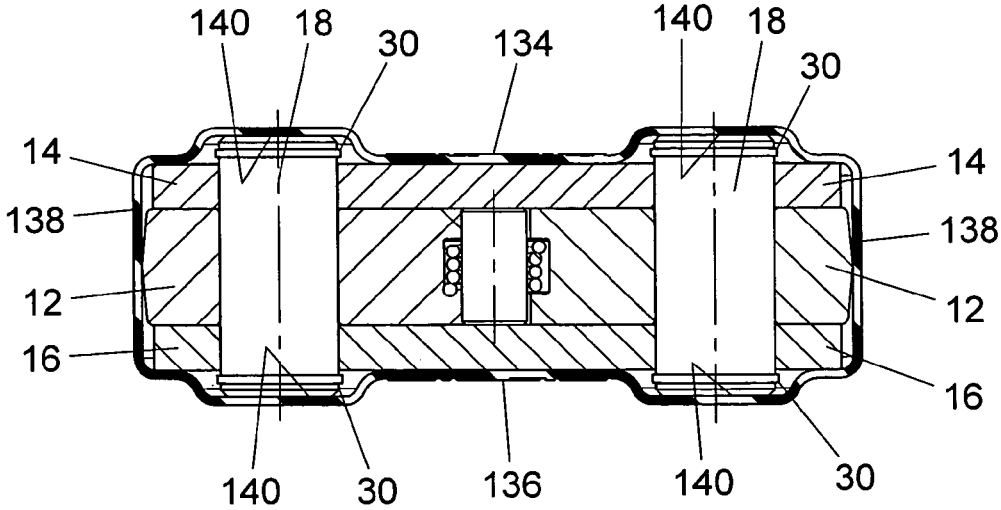
FIG. 20 is a cross-sectional view taken along Line 20-20 in FIG. 19.

FIGS. 19 and 20 illustrate an identification attachment 132 in the form of a closed sleeve of a resilient polymer material having opposite sides 134 and 136 respectively overlying the outer sides of side plates 14 and 16, and having opposite ends 138 between sides 134 and 136 and extending across the outer sides of the side plates and jawarms of the compression tool. The sleeve is adapted to be slid into position such as from the front ends of the jawarms, and the inner sides of sides 134 and 136 are provided with aligned recesses 140 adapted to receive the outer ends of the pivot pins 18 of the tool and to interengage therewith so as to removably retain the attachment on the tool. Again, the outer surfaces of sides 134 and 136 as well as the outer surfaces of ends 138 provide areas for receiving desired indicia. While the attachment is preferably of one-piece construction, it will be appreciated that sides 134 and 136 and ends 138 could be separate parts interconnected by fasteners therebetween.

Figure 21:
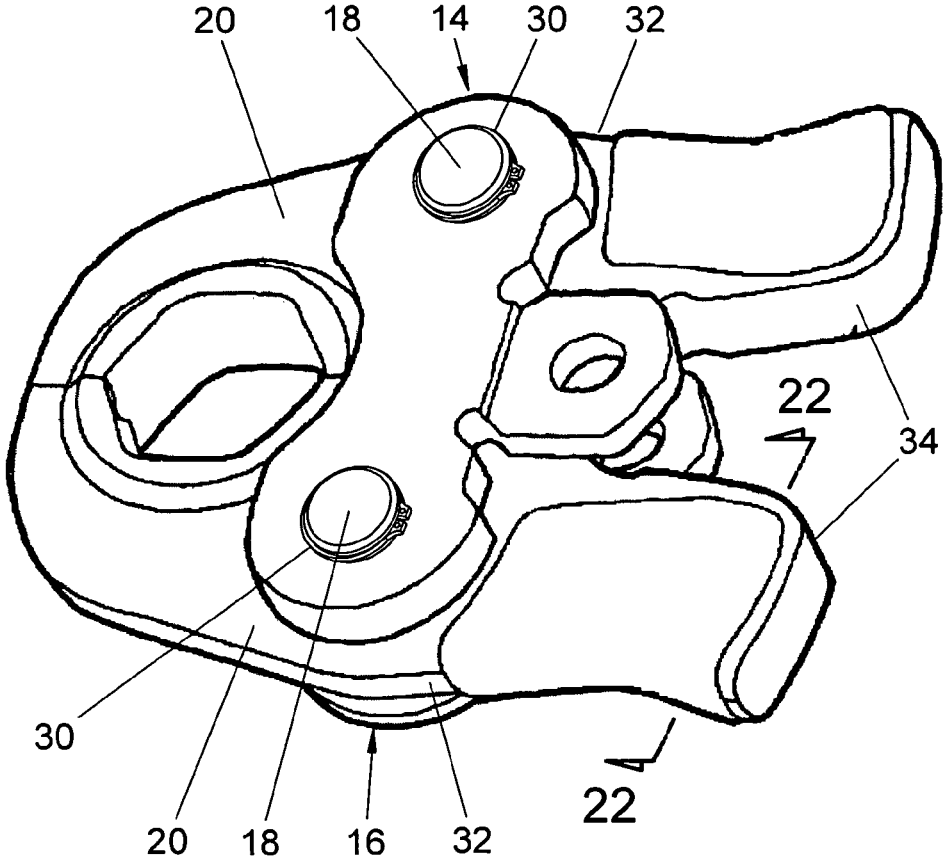
FIG. 21 is a perspective view of a compression tool having a further embodiment of an identification attachment according to the invention mounted thereon; and, FIG. 22 is a cross-sectional view taken along Line 22-22 in FIG. 21.
Figure 22:
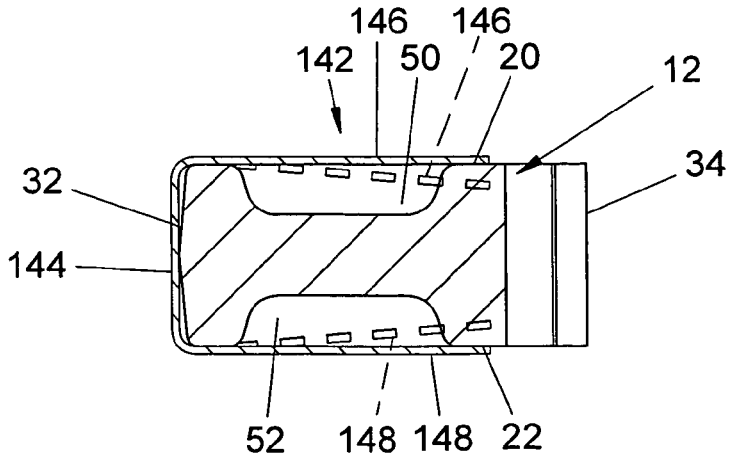

FIGS. 21 and 22 of the drawing illustrate an attachment 142 which is U-shaped in cross-section and, preferably, is constructed of spring steel to provide a ridging portion 144 extending across outer edge 32 of a jawarm and legs 146 and 148 extending inwardly along opposite sides 20 and 22 of the jawarm. As shown by the broken line position of legs 146 and 148, prior to mounting the attachment on a jawarm the legs converge in the direction from bridging portion 144 toward the free ends of the legs, whereby the legs are spread and compressively engage sides 20 and 22 of the jawarm when the attachment is mounted thereon to removably retain the attachment in place on the jawarm. While this embodiment is shown in connection with a jawarm having recesses in the opposite sides thereof, jawarms can be manufactured without such recesses and, in such case, frictional retention of the attachment on the jawarm is enhanced by the planar surfaces of the jawarm.

In the embodiments herein illustrated wherein the attachment is in the form of a plate or sheet of plastic or metal, and as mentioned herein, indicia can be provided thereon, for example, by printing, etching, embossing, and/or cutting through the sheet material. Moreover, the attachments can be color coded such as by painting or the use of colored plastic materials.

While considerable emphasis has been placed herein on preferred embodiments of the invention, it will be appreciated that other embodiments can be devised and that many modifications can be made with regard to the preferred embodiments without departing from the principles of the invention. Accordingly, it is to be distinctly understood that the foregoing descriptive matter is to be interpreted merely as being illustrative of the present invention and not as a limitation and that it is intended to include other embodiments and all modifications of the preferred embodiments insofar as they come within the scope of the appended claims or the equivalents thereof.

The invention claimed is:

1. An identification attachment for a compression tool including a pair of jawarms pivotally mounted between a pair of side plates by pivot pins having outer ends including pin retainers for maintaining the jawarms and side plates in assembled relationship, said jawarms having opposite sides, inner and outer edges and front and rear ends, respectively forwardly and rearwardly of said side plates, said identification attachment being mountable on said tool independent of any mounting openings for the attachment extending through the jawarms, and having a bridging portion for extending across the outer edge of a jawarm and legs extending downwardly from the bridging portion along the opposite sides of the jawarm, wherein said bridging portion and said legs are retained in a U-shape by fasteners therebetween.

2. An attachment according to claim 1, wherein said bridging portion and said legs are hingedly interconnected and said fasteners interengage the bridging portion and legs against pivoted displacement relative to one another.

3. An identification attachment for a compression tool including a pair of jawarms pivotally mounted between a pair of side plates by pivot pins having outer ends including pin retainers for maintaining the jawarms and side plates in assembled relationship, said jawarms having opposite sides, inner and outer edges and front and rear ends, respectively forwardly and rearwardly of said side plates, said identification attachment being mountable on said tool independent of any mounting openings for the attachment extending through the jawarms, and having a mounting portion for interengagement with at least one of the pivot pins of a compression tool, wherein the mounting portion includes an opening for receiving said at least one pivot pin, said pivot pin extending through the opening and the attachment captured to said tool by one of said pin retainers engaging an outer end of said pivot pin extending through said opening and said pin retainer contacting an outer surface of said mounting portion of said attachment.

4. An attachment according to claim 3, including a plate having opposite ends, said mounting portion including an opening at each of said opposite ends.

5. An attachment according to claim 4, wherein said plate is for overlying at least a portion of at least one of the side plates of a compression tool for retention on the tool by the pin retainer for the pin received in the opening at each end of the plate.

6. An attachment according to claim 5, wherein said plate is planar for overlying a side plate and the openings at the opposite ends of the plate are for receiving a corresponding one of the pivot pins of a compression tool.

7. An attachment according to claim 5, wherein the plate is U-shaped for each of the opposite ends thereof to overlie a different one of the side plates and for the openings at the opposite ends of the plate to be aligned to receive one of the pivot pins of a compression tool.

8. An attachment according to claim 3, wherein said mounting portion includes a plate for overlying at least a portion of at least one of the opposite sides of at least one of the jawarms of a compression tool for retention on the tool by the side plate overlying the at least one of the opposite sides of the at least one jawarm.

9. An attachment according to claim 8, wherein the plate includes a U-shaped portion including legs overlying at least a portion of the opposite sides of the at least one jawarm.

10. An attachment according to claim 3, including a bridging portion for extending across the outer edge of a jawarm rearwardly of the side plates of a compression tool and legs extending downwardly from the bridging portion along the opposite sides of the jawarm, said mounting portion extending from at least one of said legs between the corresponding side of the jawarm and the side plate overlying said corresponding side of the jawarm.

11. An attachment according to claim 3, including a sleeve having opposite sides and opposite ends, said sleeve receiving a compression tool for the opposite sides of the sleeve to span the side plates and outer ends of the pivot pins and for the opposite sides of the sleeve to extend across the outer edges of the jawarms, said opposite sides of the sleeve including recesses for receiving the outer ends of the pivot pins of the compression tool for retaining the sleeve thereon.

12. The identification attachment according to claim 3, wherein said mounting portion includes a plate for overlying at least a portion of at least one of the opposite sides of at least one of the jawarms of the associated compression tool for retention on the tool by the side plate overlying the at least one of the opposite sides of the at least one jawarm.

13. The identification attachment according to claim 3, including a bridging portion for extending across the outer edge of a jawarm rearwardly of the side plates of a compression tool and legs extending downwardly from the bridging portion along the opposite sides of the jawarm, said mounting portion extending from at least one of said legs between the corresponding side of the jawarm and the side plate overlying said corresponding side of the jawarm.

14. The identification attachment according to claim 3, including a sleeve having opposite sides and opposite ends, said sleeve receiving the associated compression tool for the opposite sides of the sleeve to span the side plates and outer ends of the pivot pins and for the opposite sides of the sleeve to extend across the outer edges of the jawarms, said opposite sides of the sleeve including recesses for receiving the outer ends of the pivot pins of the compression tool for retaining the sleeve thereon.

15. An identification attachment for a compression tool including a pair of jawarms pivotally mounted between a pair of side plates by pivot pins having outer ends including pin retainers for maintaining the jawarms and side plates in assembled relationship, said jawarms having opposite sides, inner and outer edges and front and rear ends, respectively forwardly and rearwardly of said side plates, said identification attachment being mountable on said tool independent of any mounting openings for the attachment extending through the jawarms, and having a mounting portion for interengagement with at least one of the pivot pins of a compression tool wherein the mounting portion includes an opening for receiving said at least one pivot pin, and a plate for overlying at least a portion of at least one of the opposite sides of at least one of the jawarms of a compression tool for retention on the tool by the side plate overlying the at least one of the opposite sides of the at least one jawarm wherein said plate includes a planar portion with respect to said at least one side of said at least one jawarm and has a pair of openings each for a different one of the pivot pins of the compression tool.

16. An identification attachment for an associated compression tool including a pair of jawarms pivotally mounted between a pair of side plates by pivot pins having outer ends including pin retainers for maintaining the jawarms and side plates in an assembled relationship, said jawarms having opposite sides, inner and outer edges and front and rear ends, respectively forwardly and rearwardly of said side plates, said identification attachment being selectively mountable on said associated tool and having a mounting portion including an opening for receiving therethrough at least one of the pivot pins of the associated compression tool.

17. The identification attachment according to claim 16, including a plate having opposite ends, said mounting portion including an opening at each of said opposite ends.

18. The identification attachment according to claim 17, wherein said plate is for overlying at least a portion of at least one of the side plates of the associated compression tool for retention on the tool by the pin retainer for the pin received in the opening at each end of the plate.

19. The identification attachment according to claim 18, wherein said plate is planar for overlying a side plate and the openings at the opposite ends of the plate are for receiving a corresponding one of the pivot pins of the associated compression tool.

20. The identification attachment according to claim 18, wherein the plate is U-shaped for each of the opposite ends thereof to overlie a different one of the side plates and for the openings at the opposite ends of the plate to be aligned to receive one of the pivot pins of the associated compression tool.

21. The identification attachment according to claim 16 wherein the attachment is mountable on said associated tool independent of any mounting openings for the attachment extending through the jawarms of the associated compression tool.

22. The identification attachment according to claim 16 wherein said mounting portion is adapted for interengagement with said at least one of the pivot pins of the associated compression tool.

23. An identification attachment for a compression tool including a pair of jawarms pivotally mounted between a pair of side plates by pivot pins having outer ends including pin retainers for maintaining the jaw arms and side plates in assembled relationship, said jawarms having opposite sides, inner and outer edges and front and rear ends, respectively forwardly and rearwardly of said side plates, said identification attachment being mountable on said tool independent of any mounting openings for the attachment extending through the jawarms, and having a mounting portion for interengagement with at least one of the pivot pins of a compression tool, wherein said mounting portion includes a plate for overlying at least a portion of at least one of the opposite sides of at least one of the jawarms of the associated compression tool for retention on the tool by the side plate overlying the at least one of the opposite sides of the at least one jawarm, wherein said plate includes a planar portion with respect to said at least one side of said at least one jawarm and has a pair of openings each for a different one of the pivot pins of the associated compression tool.

24. The identification attachment according to claim 12, wherein the plate includes a U-shaped portion including legs overlying at least a portion of the opposite sides of the at least one jawarm.

* * * * *